US010502172B2

(12) United States Patent
Legrand

(10) Patent No.: US 10,502,172 B2
(45) Date of Patent: Dec. 10, 2019

(54) FUEL INJECTOR WITH DEVICE FOR DETECTING NEEDLE POSITION

(71) Applicant: DELPHI TECHNOLOGIES IP LIMITED, St. Michael (BB)

(72) Inventor: Philippe Legrand, St. Gervals la Foret (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 227 days.

(21) Appl. No.: 15/327,687

(22) PCT Filed: Jul. 8, 2015

(86) PCT No.: PCT/EP2015/065583
§ 371 (c)(1),
(2) Date: May 22, 2017

(87) PCT Pub. No.: WO2016/012242
PCT Pub. Date: Jan. 28, 2016

(65) Prior Publication Data

US 2017/0268473 A1 Sep. 21, 2017

(30) Foreign Application Priority Data

Jul. 22, 2014 (FR) ..... 14 57078

(51) Int. Cl.
*F02M 65/00* (2006.01)
*F02M 47/02* (2006.01)
*F02M 51/00* (2006.01)

(52) U.S. Cl.
CPC ..... *F02M 65/005* (2013.01); *F02M 47/027* (2013.01); *F02M 51/005* (2013.01)

(58) Field of Classification Search
CPC .... F02M 65/005; F02M 57/005; F02M 51/06; F02M 51/005
USPC ..... 239/533.9; 123/494; 137/554; 251/129.04
See application file for complete search history.

(56) References Cited

U.S. PATENT DOCUMENTS 4,341,241 A * 7/1982 Baker ..... F16K 37/0041 137/554
4,386,522 A * 6/1983 Wolff ..... G01D 5/145 73/114.47
4,540,154 A * 9/1985 Kolchinsky ..... F16K 31/408 137/315.03
4,667,511 A * 5/1987 Mausner ..... F02M 65/005 73/114.47
RE33,649 E * 7/1991 Kawai ..... G01F 1/26 137/486

(Continued)

FOREIGN PATENT DOCUMENTS

DE 102004015745 A1 10/2005
DE 102005002796 A1 8/2006

(Continued)

*Primary Examiner* — Viet Le
(74) *Attorney, Agent, or Firm* — Joshua M. Haines

(57) ABSTRACT

A fuel injector includes a needle that can move between an entirely open position and a closed position is provided with a device for identifying the position of the needle, in which an electrical circuit is closed in the two extreme positions, the needle being in electrical contact with ground, the circuit being open in any other intermediate position of the needle, the needle not being grounded.

8 Claims, 3 Drawing Sheets

(56) References Cited

U.S. PATENT DOCUMENTS 5,032,015 A * 7/1991 Christianson ..... A47G 1/02 359/512
5,372,313 A * 12/1994 Chabon ..... F02M 51/0646 239/585.1
5,595,215 A * 1/1997 Wallace ..... F02M 65/005 137/554
6,062,498 A * 5/2000 Klopfer ..... F02M 47/027 123/494
6,182,941 B1 * 2/2001 Scheurenbrand ..... F15C 5/00 137/554
6,253,736 B1 * 7/2001 Crofts ..... F02M 47/027 123/467
6,715,693 B1 * 4/2004 Dam ..... F02M 61/166 239/533.11
8,091,860 B2 * 1/2012 Thompson ..... F16K 3/246 137/554
8,118,276 B2 * 2/2012 Sanders ..... G05B 19/39 137/554
8,485,497 B2 * 7/2013 Alessandro ..... F16K 11/07 137/554
8,505,573 B2 * 8/2013 Herbert ..... F16K 31/0672 137/554
8,555,860 B2 * 10/2013 McAlister ..... F02M 57/005 123/490
8,813,778 B2 * 8/2014 Bachmann ..... F16K 31/02 137/554
8,925,895 B2 * 1/2015 Takemoto ..... F15B 19/005 137/554
8,931,504 B2 * 1/2015 Canjuga ..... F16K 1/126 137/220
9,567,957 B2 * 2/2017 Schmieder ..... F02M 51/005
10,100,794 B2 * 10/2018 Barbier ..... F02M 47/027
2002/0138969 A1 * 10/2002 Dallmeyer ..... F02M 51/005 29/602.1
2003/0111049 A1 * 6/2003 Lewis ..... F02M 47/027 123/446
2003/0121994 A1 * 7/2003 Yudanov ..... F02M 65/005 239/533.9
2003/0183792 A1 * 10/2003 Muraji ..... F01L 9/04 251/129.04
2005/0127314 A1 * 6/2005 Piehl ..... F15B 13/044 251/129.04
2005/0199746 A1 * 9/2005 Bartunek ..... F02M 51/0603 239/102.2
2005/0269422 A1 * 12/2005 Gerber ..... F02M 65/005 239/102.2
2007/0152659 A1 * 7/2007 Gurich ..... F02M 59/44 324/207.24
2010/0088006 A1 * 4/2010 Ito ..... F02D 41/2096 701/103
2012/0325935 A1 * 12/2012 Wuerfel ..... F02M 51/0603 239/533.2
2013/0327132 A1 * 12/2013 Omeri ..... F02D 41/20 73/114.45
2013/0341421 A1 * 12/2013 Mueller ..... F02M 61/08 239/5
2014/0217204 A1 * 8/2014 Chandrashekar .... F02M 51/005 239/585.5
2014/0326218 A1 * 11/2014 Ruße ..... F02D 41/2096 123/478
2015/0122000 A1 * 5/2015 Willimowski ..... F02M 51/00 73/114.45
2015/0256114 A1 * 9/2015 Sanchez Gonzalez ..... F02D 41/20 318/128
2016/0177855 A1 * 6/2016 Kusakabe ..... F02D 41/20 123/490
2016/0252034 A1 * 9/2016 Li ..... F02M 63/0026 239/4
2017/0268473 A1 * 9/2017 Legrand ..... F02M 47/027
2018/0017369 A1 * 1/2018 Yoshiya ..... G01B 7/004
2018/0171955 A1 * 6/2018 Rezaei ..... F02M 65/005
2018/0209370 A1 * 7/2018 Moriyama ..... F02D 45/00
2018/0372018 A1 * 12/2018 Suenderhauf ..... F02M 61/166

FOREIGN PATENT DOCUMENTS

DE 102005007329 B3 9/2006
DE 102005018589 A1 11/2006
GB 2320522 A 6/1998
GB 2340610 A 2/2000
WO 2004097210 A1 11/2004

* cited by examiner

FUEL INJECTOR WITH DEVICE FOR DETECTING NEEDLE POSITION

CROSS REFERENCE TO RELATED APPLICATIONS

This application is a national stage application under 35 USC 371 of PCT Application No. PCT/EP2015/065583 having an international filing date of Jul. 8, 2015, which is designated in the United States and which claimed the benefit of FR Patent Application No. 1457078 filed on Jul. 22, 2014 the entire disclosures of each are hereby incorporated by reference in their entirety.

TECHNICAL FIELD

The invention relates to a fuel injector provided with a device for detecting the position of the needle.

TECHNOLOGICAL BACKGROUND TO THE INVENTION

A fuel injector conventionally comprises a needle that is driven so as to open and close as a function of the pressure prevailing in a control chamber, which pressure depends on the position of a solenoid control valve. The small movements are carried out at high speed, and consistently enhanced performance is now requiring feedback of information regarding the actual position of the needle for optimal control. Devices are known in which a sensor is arranged on the injector, or an injector in which the surfaces of the components of the body are electrically insulated so that an electrical resistance measurement can be carried out between two elements of the body of the injector. Complex and expensive devices have not yet proven their industrial viability, and there is a need to provide a simple and effective device.

SUMMARY OF THE INVENTION

The present invention proposes to resolve these problems at least partially by providing a fuel injector comprising an injector body in which a needle that can move between an entirely open position and a closed position and a spring constantly pressing the needle toward the closed position are arranged, the injector being arranged in a way that, during use the injector body is in electrical contact with the electrical ground.

The injector is furthermore provided with a device for identifying the position of the needle, in which an electrical circuit is closed when the needle is in the entirely open position and also when the needle is in the closed position. The needle is then in electrical contact with the ground, the circuit being open in any other intermediate position of the needle, the needle not being electrically grounded.

More particularly, the circuit comprises the injector body, the needle and the spring, as well as an electrical connection extending from the spring to an end external to the injector, such as a lug of a connector. An electrical measurement can thus be carried out between said external end and the ground.

In more detail, the injector comprises inter alia a nozzle and a control valve, the nozzle itself comprising a nozzle body, an upper guide and a lower guide, a valve body seat and injection holes. The nozzle also comprises the needle, which extends between a first end provided with a needle seat and a second end forming the head of the needle, the needle being arranged so as to slide between the upper guide and the lower guide and being capable of moving between the closed position, in which the needle seat is in contact with the valve body seat, fuel injection being prevented, and the entirely open position, in which the needle seat is separated from the valve body seat, injection being possible. The nozzle also comprises the metal spring compressed between a bearing surface secured to the nozzle body and a shoulder of the needle.

The control valve comprises a valve body arranged fixed on the nozzle body so as to define together a control chamber in which the head of the needle is located, the movements of the needle being dependent on the pressure variations in the control chamber so that, in the entirely open position, the top of the head of the needle is in contact with a wall of the control chamber, said wall forming the roof of the control chamber.

The injector body comprises, inter alia, the nozzle body and the valve body.

The device for identifying the position of the needle makes it possible to generate a variable electrical signal representing the position of the needle. The device comprises the electrical insulation of the surfaces of the needle, or of the surfaces of the injector body, which may be in contact with one another, except for the needle seat and the valve body seat, the top of the head of the needle and the roof of the control chamber, and the bearing shoulder of the spring on the needle. The other bearing face of the spring, on the other hand, the bearing face secured to the nozzle body, is for its part electrically insulated.

In one specific design version, the upper guide is integrated with the nozzle body, the interface between the nozzle body and the valve body being planar. The electrical circuit furthermore comprises a member in the form of a planar disk arranged between the nozzle body and the valve body. The disk is provided with an opening located just above the control chamber, the opening being slightly smaller than the control chamber so that the disk penetrates slightly into the control chamber and extends at the periphery of the roof of the control chamber. The disk is formed by a metal disk provided with an electrically insulating coating on its two opposite faces, except for the perimeter of the opening located at the periphery of the roof, an insulator-free surface against which the spring bears. Thus, in the entirely open position the head of the needle extends through the opening and its top is in contact with the roof of the control chamber. It should be noted that the insulating coating may be obtained by depositing a material layer or alternatively by a suitable surface treatment.

The planar disk is provided with positioning openings and with protuberances extending perpendicularly to the plane of the disk from the perimeter of said positioning openings, so as to be arranged in a complementary fashion in blind positioning holes provided in the valve body and in the nozzle body. One embodiment of the planar disk, the protuberances are obtained by folding cut-out parts of the disk through a right angle. In another embodiment, the disk may be planar and centering means, such as studs, may be fitted on the disk.

The electrical connection furthermore comprises an intermediate connection link passing through a leaktight conduit crossing the valve body. The connection link extends from an end connected to the metal disk to said external end, for example a lug of a connector.

According to another embodiment of the injector, the upper guide is an independent piece arranged fixed between the nozzle body and the valve body, and the spring is compressed between a bearing face integrated with the needle and a bearing face secured to the upper guide. The electrical connection comprises an annular disk interposed between the spring and the upper guide, the interface between the annular disk and the upper guide being electrically insulated, the needle passing through a central opening of the annular disk.

The upper guide is then provided with a conduit crossing it fully, a connection tab being configured in order to extend from the annular disk into said conduit.

In one alternative, the electrical connection comprises an intermediate connection link extending through a leaktight and electrically insulated conduit crossing the valve body to an end connected to the annular disk.

Irrespective of the embodiment, the electrical resistance between the needle and the ground is less than 1 kiloohm when the circuit is closed and is more than 100 kiloohms, or even 400 kiloohms, when the circuit is open. What is important is that the difference between the open-circuit and closed-circuit resistance values is large, so that discrimination is easy.

DESCRIPTION OF THE FIGURES

An embodiment of the invention will now be described by means of the following figures.

DESCRIPTION OF THE PREFERRED EMBODIMENTS

Figure 1:
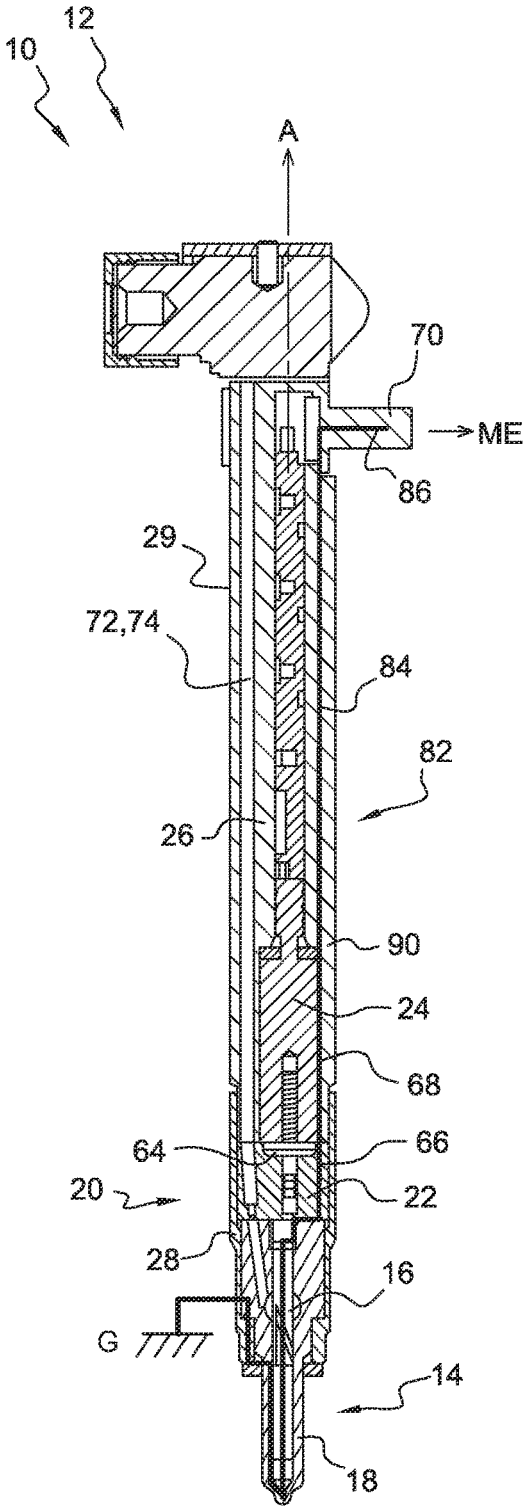
FIG. 1 is an axial section of an injector according to a first embodiment of the invention, the injector being in the closed position.
Figure 2:
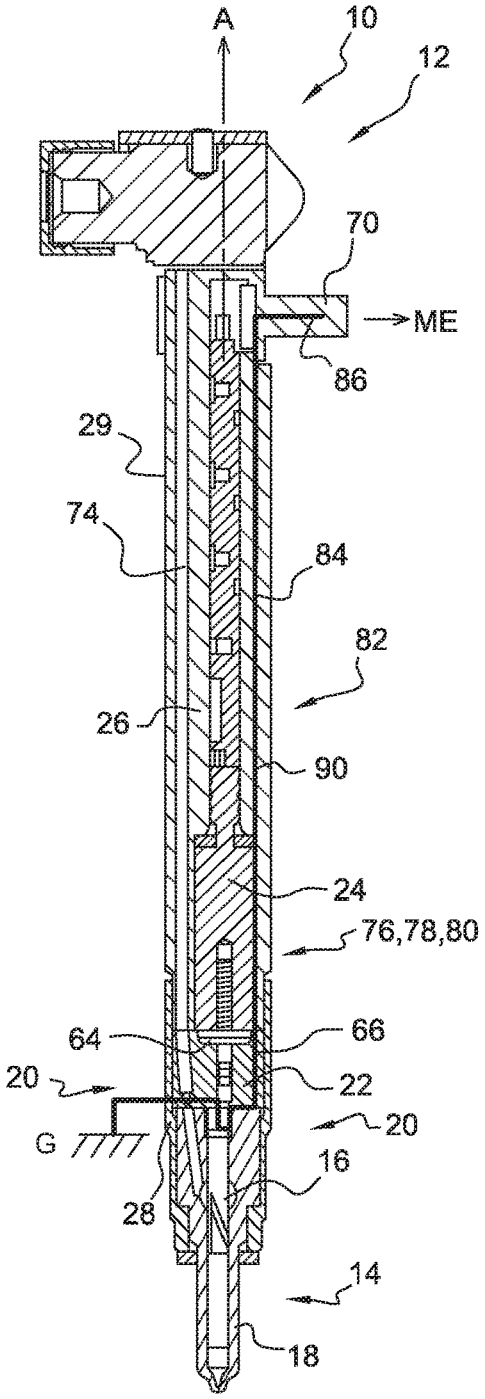
FIG. 2 is the injector of FIG. 1 in the open position.
Figure 3:
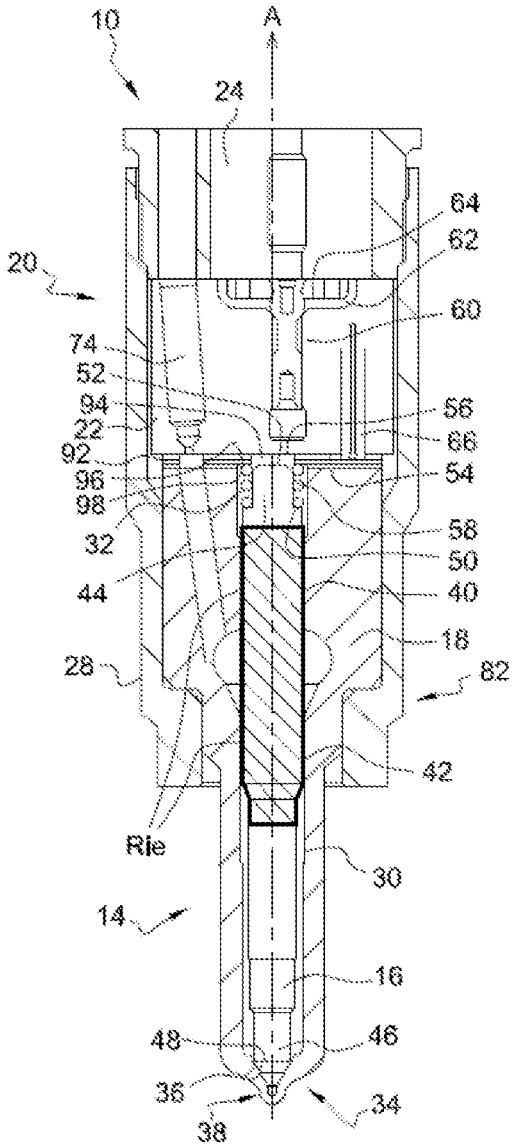
FIG. 3 is a magnified axial section of the injector of FIG. 1.

According to FIGS. 1, 2 and 3, a first embodiment of the invention relating to a fuel injector 10 is described, in this case a diesel injector, although the invention may be fully adapted to an injector of gasoline or any other fuel, the injector 10 generally forming part of an injection system 12 comprising a plurality of injectors 10. The description will detail the elements of the invention and will remain briefer and more general as regards the surrounding elements.

The injector 10 extends along a principal axis A and comprises, from bottom to top, according to the conventional and nonlimiting direction of the drawings, a nozzle 14 comprising a needle 16 arranged in a nozzle body 18, then a control valve 20 arranged in a valve body 22 then an actuator 24 arranged in an actuator body 26. The nozzle body 18, the valve body 22 and the actuator body 26 are kept secured to one another by an injector nut 28, which bears on a shoulder of the nozzle body 18 and is screwed onto the actuator body 26, the valve body 22 being sandwiched between the other two bodies, the three bodies and the nut forming the body of the injector 29.

The nozzle body 18 comprises an inner axial bore 30 extending from an upper end, where it widens slightly into a deep countersink in order to partly define a control chamber 32, to a lower end 34 narrowing to a tip so as to form a conical valve body seat 36 making it possible to control the access of fuel to the injection holes 38 extending through the conical wall of the nozzle body 18. Between the control chamber 32 and the valve body seat 36, the bore 30 forms an upper cylindrical guide 40 and a lower cylindrical guide 42, between which the needle 16 is arranged so as to slide axially. The terms "upper" and "lower" are used here not only with reference to the orientation of the figure, but also with reference to the conventional term assigned to these elements by professionals.

The needle 16 is cylindrical overall and extends axially A between a needle head 44, at the top of the figure, and a pointed end 46 at the bottom of the figure, forming a needle seat 48 cooperating with the valve body seat 36 of the body 18. As can be seen in FIG. 3, the needle head 44 opens into the control chamber 32. The head 44 has a smaller diameter d44 than the rest of the needle 16, and it extends upward from a shoulder 50 to a head top surface 52.

The body of the control valve 22 is arranged in the conventional way above the nozzle body 18, and the lower face 54 of the valve body forms in its central part the roof 56 of the control chamber 32.

In the control chamber 32, a metal spring 58 bears against the shoulder 50 of the needle so as to constantly press the needle 16 toward a closed position PF, in which the needle seat 48 is in leaktight contact against the valve body seat 36 of the body.

The valve body 22 is furthermore provided in the conventional way with a bore 60 opening onto a wide space 62, an assembly consisting of the magnetic yoke and a valve rod 64 being in the conventional way mounted so as to slide in the bore 60, the said assembly 64 having overall the shape of a T, the upper bar representing a magnetic yoke and the vertical limb representing a valve rod.

Parallel to the bore 60, the valve body 22 is crossed entirely by an emergent conduit 66, which is represented on the right in the cross section of FIG. 3 even though, as will be explained further on, the conduit may be formed at a different position of the valve body 22, so long as it opens on both sides.

The actuator body 26, arranged in the conventional way above the control valve 20, is provided with a complementary conduit 68 arranged so as to be aligned with the emergent conduit 66 of the valve body and to extend to a connector 70 arranged at the top of the actuator body 26.

The injector 10 is furthermore provided in the conventional way with a circulation circuit 72 for the fuel, which allows on the one hand delivery of fuel at high pressure via a high-pressure circuit 74, delivery from an entry orifice to the injection holes 38, and on the other hand recirculation of fuel to a low-pressure reservoir via a low-pressure circuit 76. The high-pressure circuit 74 comprises, in particular, a branch channel 78 leading to the control chamber 32, from which chamber 32 the low-pressure circuit 76 leaves through a discharge channel 80, the opening and closure of which are controlled by the control valve 20.

When the actuator 24, typically an electromagnet, is supplied with electricity, it attracts the magnetic yoke 64, which causes the discharge channel 80 to open and allows the fuel trapped in the control chamber 32 to be discharged to the low-pressure circuit 76. The pressure in the control chamber 36 then decreases, and the needle 16 moves in the bore 30 of the nozzle body 18 to an entirely open position PO, in which the needle seat 48 is separated from the valve body seat 36, so as to allow injection of fuel through the injection holes 38, and in which the top 52 of the needle head is in contact with the roof surface 56 of the control chamber 32.

When the actuator 24 is not supplied, the assembly consisting of the magnetic yoke and the valve rod 64 is pushed back by a valve spring to a position in which the discharge channel 80 is closed, which causes retention in the control chamber 32 of the high-pressure fuel arriving therein. The pressure in the control chamber 32 then increases, and the needle 16, pushed back by the spring 58 and by the pressure in the control chamber 32, moves to the closed position PF, in which the needle seat 48 is in leaktight contact against the valve body seat 36, so as to prevent injection of fuel, and in which the top 52 of the head of the needle is separated from the roof surface 58 of the control chamber.

The injector 10 furthermore comprises a device 82 for identifying the extreme positions of the needle.

The device 82 is an electrical circuit 84 making it possible to carry out an electrical measurement EM between a lug 86 of the connector and the ground G to which the nozzle body 18, the valve body 22, the actuator body 26 and the injector nut 28 are connected.

When the needle 16 is in the closed position PF, FIG. 1, the electrical circuit 84 comprises an electrical connection 88 which extends from the lug 86 to the spring 58, then the spring 58 itself, then the needle 16 as far as the needle seat 48, and finally the nozzle body 18 from the valve body seat 36 to the ground G.

When the needle 16 is in the entirely open position PO, FIG. 2, the electrical circuit 84 comprises the electrical connection 88 of the lug 86 to the spring 58, then spring 58 itself, then the needle 16 as far as its head top 52, then the valve body 22 from the roof 56 of the control chamber to the ground G.

In these two extreme positions PO, PF, the electrical circuit 84 is closed and an electrical measurement can be carried out, the said measurement signifying an extreme position. An injection cycle comprises not only a main opening during which the needle 16 travels through all of the distance between the two extreme positions, but also brief openings during which the needle 16 leaves the closed position PF but does not reach the entirely open position PO and stops in an intermediate position Pi, referred to as a ballistic position.

In a ballistic position, the needle seat 48 is separated from the valve body seat 36 and the top 52 of the needle head is separated from the roof 56 of the control chamber, so that the electrical circuit 84 is open. The electrical measurement EM carried out is then different from that carried out when the circuit 84 is closed.

In order to distinguish between the needle positions, the electrical measurement carried out is set in relation with the electrical controlling of the actuator. Thus, when the circuit 84 is closed, if the actuator is being supplied with electricity then the needle is in the entirely open position PO, and if the actuator is not being supplied the needle 16 is in the closed position PF, and if the actuator is only being supplied with electricity so as cause only brief opening, then the initially closed circuit 84 opens when the needle leaves the closed position PF then the circuit 84 closes again, which indicates that the needle 16 has returned to the closed position PF without opening fully.

Figure 8:
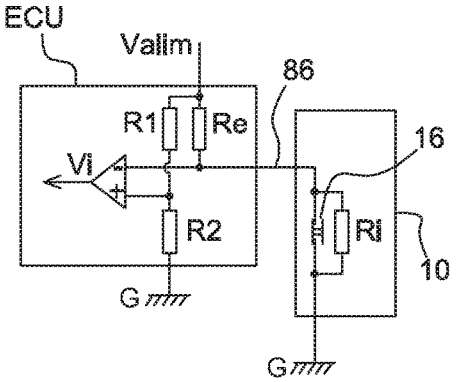
FIG. 8 is a circuit diagram representing the invention.

FIG. 8 briefly describes an example of an electrical circuit making it possible to acquire and measure the signal representing the position of the needle 16.

The injector 10 is schematized by an electrical circuit 84 comprising, between the lug 86 and the ground G, the needle 16 schematized as a switch, in parallel with which an insulation resistance Ri is placed. The insulation resistance Ri typically has a value of more than 100 kiloohms, so that in the closed position PF the electrical resistance of the circuit 84 is zero and in the open position PO the electrical resistance of the circuit 84 is equal to the insulation resistance Ri.

Furthermore, the injector 10 is connected to a computer ECU comprising a fixed electrical resistance Re which is much less than the insulation resistance Ri, and for example a fixed resistance Re may be selected whose value lies between 10 and 50 kiloohms, for example 20 kiloohms, two other electrical resistances R1, R2, and an electrical voltage comparator.

At the terminals of the voltage comparator, on the one hand a first, reference electrical voltage whose level depends on the combination of the other two electrical resistances R1, R2, and on the other hand a second voltage varying as a function of the open or closed state of the circuit 84 arrive. In order to make this second electrical voltage vary, the terminal of the comparator is also connected to the lug 86 of the injector 10. Thus, in the closed position PF, this terminal receives a zero voltage because it is connected to the ground G, and in the open position PO the same terminal receives a nonzero voltage greater than the reference electrical voltage. The change thus perceived by the voltage comparator reveals the position of the needle 16.

As an alternative, a measurement of the current flowing through the electrical circuit of the injector would make it possible to identify the open position PO or closed position PF of the needle.

The electrical circuit 84 is now described in detail. It comprises on the one hand the electrical insulation of the surfaces of the needle 16 which are capable of being in contact with the nozzle body 18. Thus, surfaces S1 and S2 guided respectively in the upper guide 40 and the lower guide 42 are coated with an insulating surface coating Rie. Among the known deposits, there are aluminum nitride, aluminum oxide, amorphous carbon "DLC", and there are also plastic materials with high mechanical properties, or alternatively the electrical insulation of the surfaces may be carried out by methods of surface oxidation or surface nitriding. Additional bushes arranged around the needle, or in the injector body, may also be envisioned. Conversely, the needle seat 48, the top 52 of the head and the shoulder 50 against which the spring 58 bears remain electrically conductive and free from insulating coating Rie, although these surfaces may have other surface coatings so long as they are electrically conductive. One possible alternative is to insulate almost all of the needle, while keeping free only the three surfaces mentioned above. In another alternative, the insulating coating Rie coats the corresponding surfaces of the nozzle body 18, in particular the upper guide 40 and the lower guide 42, or the surfaces of the nozzle body and the surfaces of the needle. In this case, with the deposit, it will sometimes be preferred to arrange insulating bushes fitted into the bores. On the other hand, the electrical connection 88 of the electrical circuit 84 comprises an upper link 90 which extends through the actuator body 26 in the complementary conduit 68 and through the valve body 22 in the emergent conduit 66, then a member in the form of a disk 92 arranged between the valve body 22 and the nozzle body 18. The disk 92 is provided with an opening 94 arranged just above the control chamber 32, the opening 94 being central in the example of FIG. 3. The opening 94 is slightly smaller than the control chamber 32, so that the disk extends inside the control chamber, at the perimeter of the roof 56. This peripheral extension 96 is sufficient for its lower face 98 to be used as a bearing face for the spring 58, which is therefore compressed between this bearing face 98 and the shoulder 50 of the needle. Furthermore, the opening 94 is wide enough so that, in the entirely open position PO of the needle 16, the head 44 can pass through the opening 90 without touching the edge and can come in contact with the roof 56 of the control chamber 32.

More specifically, the disk 92 is a metal disk whose two opposite faces are electrically insulated Rie except for the bearing face 98 of the spring, and of course the connection to the upper link 90, which remain electrically conductive. As an alternative, the opposite faces of the disk 92 may be electrically conductive, although in this case it is the faces of the valve body and of the nozzle body in contact with the disk 92 which must be electrically insulated.

Figure 7:
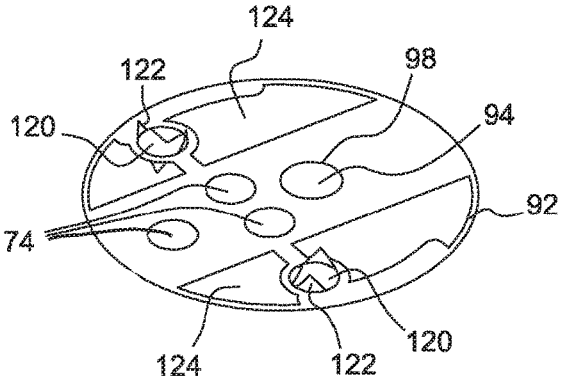
FIG. 7 is an isometric view of the disk arranged in the injector of FIG. 3.

As can be seen particularly clearly in the nonlimiting example of FIG. 7, the disk 92 is provided with other complementary openings, in particular so as not to obstruct the high-pressure circuit 74 leading to the control chamber 32 or to the injection holes 38. Openings necessary for the circulation circuits of the fuel can be seen, as well as two symmetrical openings 120 for positioning the nozzle body 18 with respect to the valve body 22. It is known to position the valve body and the nozzle body with precision by means of centering studs. This solution may be adopted in the scope of the present invention, the studs passing through said positioning openings 120 so as to be arranged in the nozzle body and in the valve body in complementary blind bores. These studs may then be electrically insulated from the disk 92. Nevertheless, as represented in FIG. 7, it is possible to produce said positioning openings 120 by making diagonal cut-outs then folding triangular portions perpendicularly and on either side of the disk 92, these triangular portions forming centering wedges 122 capable of engaging in a complementary fashion in said blind bores and thus advantageously replacing the centering studs. These centering wedges must also be electrically insulated so as not to create an electrical connection between the disk 92 and the valve body or the nozzle body. As an alternative, other cut-outs may lead to the production of other forms of centering protuberances.

Furthermore, in view of the very high pressures, several thousands of bars, which may prevail in the injector, it is also possible to improve the leaktightness around the disk 92 by forming wide openings 124 in the disk 92, these openings thus making it possible to reduce the surface area of the disk 92 subjected to the tightening forces between the nozzle body 18 and the valve body 22, and consequently to increase the contact pressures, making it possible to have better leaktightness around the high-pressure channels and the control chamber.

In this case, the trimming which it is known to carry out for the same purpose in the faces of the valve body and of the nozzle body are advantageously replaced with these wide openings 124 in the disk 92.

In a complementary alternative, the sidewalls of the control chamber may be electrically insulated so as not to risk creating a short circuit between an intermediate turn of the spring 58 and said wall.

Figure 4:
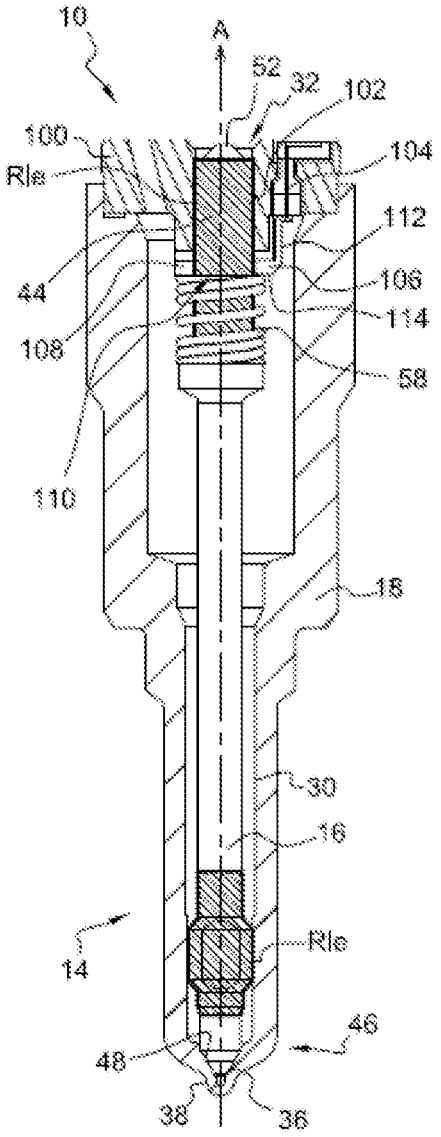
FIG. 4 is a magnified axial section of an injector according to a second embodiment.
Figure 5:
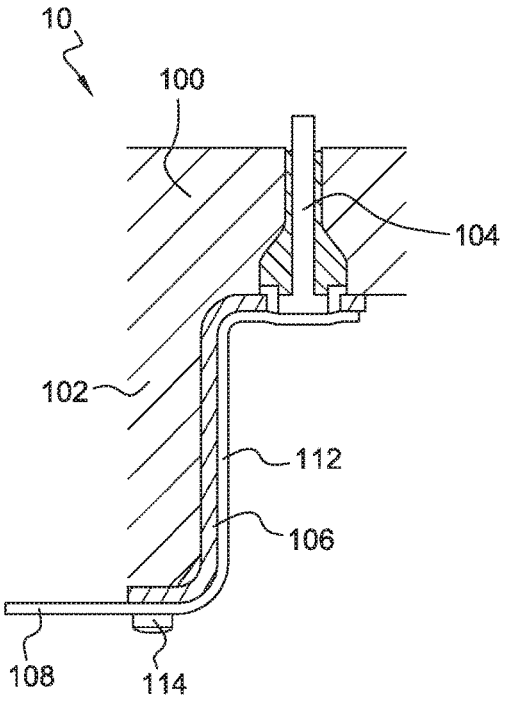
FIGS. 5 and 6 are two alternative embodiments of a component of the injector of FIG. 4.

A second embodiment is now described with reference to FIGS. 4, 5 and 6 and by way of differences from the first embodiment, while keeping the reference numbers of the common elements.

The principle of the second embodiment is identical to that of the first embodiment, the second embodiment differing mainly by the actual structure of the injector 10, in which the upper guide 40 is an independent piece 100 arranged between the nozzle body 18 and the valve body 22 and kept fixed by the compression exerted by the injector nut 28. The upper guide 100 guides the needle head 44 through a guide bore 102, and said guide bore 102 defines the control chamber 32 in combination with the valve body 22.

As can be seen, the lower guide 42 is close to the needle seat 48 and the valve seat 36, and in the nonlimiting example selected the electrically insulated surfaces are limited to the guide surfaces S1, S2. Furthermore, the needle 16 is provided with an annular protuberance of which the upper face, directed toward the needle head, fulfills a function similar to the shoulder 50 of the first embodiment, against which shoulder 50 the spring 58 bears and pushes the needle 16 toward the closed position PF. The spring 58 is therefore arranged under the upper guide 100, and no longer in the control chamber 32, and it is compressed against said shoulder 50.

The upper guide 100 is furthermore provided with a through-conduit substantially parallel to the guide bore 102, through which conduit an intermediate connection link 104 extends, which link may be either integrated with the upper link 90 and simply extend it to below the upper guide 100, or independent of the upper link 90 and connected thereto.

Before the upper guide 100, the electrical circuit 84 comprises a discoid piece 106 comprising a disk 108 provided with a central opening 110, from which annular disk 108 a connection tab 112 extends outward. The annular disk 108 is arranged between the upper guide 100 and the spring 58, the needle 16 extending through the opening 110. The lower face 114 of the disk is used as a bearing surface for the spring 58, while the connection tab 112 is matched to the profile of the upper guide 100, as shown in FIG. 5, in order to rejoin the intermediate connection link 104 below the upper guide 100. The discoid piece 106 is metallic and coated with an electrically insulating coating Rie, except for the bearing surface 114 of the spring and the end of the tab 112 electrically connected to the intermediate connection link 104.

Figure 6:
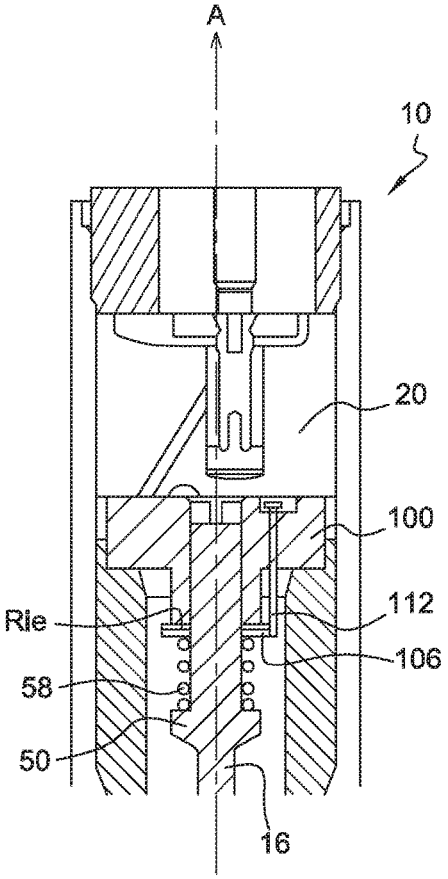

In an alternative which is represented in FIG. 6, the intermediate connection link 104 has the form of a rigid stud extending in a straight line parallel to the principal axis A and the tab 112, which is only a small projection of the annular disk 108. The discoid piece 106 could even be replaced with a simple washer, of which the inner diameter is sufficient to let the needle 16 pass through, and the outer diameter is large enough to receive the intermediate connection 104 while maintaining a sufficient passage cross section for the fuel, not generating a constriction and pressure drop. In this case, the washer does not have the tab.

When the needle 16 is in the closed position PF, the electrical circuit 84 is closed and comprises the upper link 90 and the intermediate connection link 104, then the discoid piece 106, then the spring 58, then the needle 16 as far as the needle seat 48, and finally the nozzle body 18 from the valve body seat 36 as far as the ground G.

When the needle 16 is in the entirely open position PO, the electrical circuit 84 is also closed and it comprises the upper link 90 and the intermediate connection link 104, then the discoid piece 106, then the spring 58, then the needle as far as the top 52 of the head, then the valve body 22 from the roof 56 of the control chamber as far as the ground G.

The following references have been used in the description.

10 injector
12 injection system
14 nozzle
16 needle
18 nozzle body
20 control valve
22 valve body
24 actuator
26 actuator body
28 injector nut
29 body of the injector
30 bore
32 control chamber
34 lower end
36 valve body seat
38 injection holes
40 upper guide
42 lower guide
44 needle head
46 pointed end
48 needle seat
50 shoulder
52 needle head top
54 lower face of the valve body
56 roof of the control chamber
58 spring
60 main bore of the valve body
62 wider space for the yoke
64 assembly consisting of the magnetic yoke and the valve rod
66 conduit opening into the valve body
68 complementary conduit in the actuator body
70 connector
72 circulation circuit for the fuel
74 high-pressure circuit
76 low-pressure circuit
78 branch channel
80 discharge channel
82 device for identifying the position of the needle
84 electrical circuit
86 lug
88 electrical connection
90 connection link
92 member in the form of a disk
94 central opening of the disk
96 peripheral extension
98 bearing face of the spring
100 independent upper guide
102 guide bore of the upper guide
104 intermediate connection link
106 discoid piece
108 annular disk
110 central opening of the disk
112 connection tab
114 bearing surface of the spring
120 positioning openings
122 centering wedges
124 wide openings
A principal axis
d44 head diameter
PF closed position of the needle
PO entirely open position
Pi intermediate position
G ground
EM electrical measurement
Rie electrically insulating coating
ECU computer
Vsupp supply voltage
Ri insulation resistance
Re electrical resistance
R1/R2 other electrical resistances

The invention claimed is:

1. A fuel injector comprising:

a nozzle comprising a nozzle body, an upper guide and a lower guide, a valve body seat, injection holes, and a needle which extends between a first end provided with a needle seat and a second end forming a head of the needle, the needle being arranged so as to slide between the upper guide and the lower guide and such that the needle moves between a closed position in which the needle seat is in contact with the valve body seat such that fuel injection is prevented, and an entirely open position in which the needle seat is separated from the valve body seat such that fuel injection is permitted;

a control valve comprising a valve body arranged fixed on the nozzle body so as to define together a control chamber in which the head of the needle is located, wherein movement of the needle is dependent on pressure variations in the control chamber so that, in the entirely open position, a top of the head of the needle is in contact with a wall of the control chamber, said wall forming a roof of the control chamber;

an injector body comprising the valve body, the nozzle body, and a metal spring compressed between a bearing surface secured to the nozzle body and a shoulder of the needle are arranged, the metal spring constantly pressing the needle toward the closed position, wherein the injector body is in electrical contact with electrical ground during use of the fuel injector; and a device which identifies the position of the needle, the device comprising an electrical circuit, wherein the electrical circuit is closed when the needle is in the entirely open position and also when the needle is in the closed position, the needle then being in electrical contact with electrical ground, the circuit being open in any other intermediate position of the needle, the needle not being in electrical contact with electrical ground, wherein the device which identifies the position of the needle generates a variable electrical signal representing the position of the needle, the device comprising:

electrical insulation of surfaces of the needle, or of the injector body, which may be in contact with one another, except for the needle seat and the valve body seat, the top of the head of the needle and the roof of the control chamber, and the shoulder of the spring on the needle and the bearing surface of the metal spring secured to the nozzle body;

wherein the upper guide is integrated with the nozzle body, the interface between the nozzle body and the valve body being planar, the device furthermore comprising a member in the form of a planar disk arranged between the nozzle body and the valve body, the planar disk being provided with an opening located just above the control chamber, the opening being slightly smaller than the control chamber so that the planar disk extends at a periphery of the roof of the control chamber, the planar disk being formed by a metal disk provided with an electrically insulating coating on its two opposite faces, except for the perimeter of the opening located at the periphery of the roof, an insulator-free surface against which the spring bears, so that in the entirely open position the head of the needle extends through the opening and the top of the head is in contact with the roof of the control chamber.

2. The fuel injector as claimed in claim 1, wherein the electrical circuit furthermore comprises an intermediate connection link passing through a leaktight conduit crossing the valve body, the intermediate connection link extending from an end connected to the metal disk to an external end.

3. The fuel injector as claimed in claim 1, wherein the planar disk is provided with positioning openings and with protuberances extending perpendicularly to the plane of the disk from the perimeter of said positioning openings, so as to be arranged in a complementary fashion in blind positioning holes provided in the valve body and in the nozzle body.

4. The fuel injector as claimed in claim 3, wherein the electrical circuit furthermore comprises an intermediate connection link passing through a leaktight conduit crossing the valve body, the intermediate connection link extending from an end connected to the metal disk to an external end.

5. The fuel injector as claimed in claim 1, wherein the upper guide is an independent piece arranged fixed between the nozzle body and the valve body, the spring being compressed between the shoulder integrated with the needle and a bearing face secured to the upper guide, the electrical circuit comprising an annular disk interposed between the spring and the upper guide, the interface between the annular disk and the upper guide being electrically insulated, the needle passing through a central opening of the annular disk.

6. The fuel injector as claimed in claim 5, wherein the upper guide is provided with a conduit crossing it fully, a connection tab being configured in order to extend from the annular disk into said conduit.

7. The fuel injector as claimed in claim 5, wherein the electrical circuit furthermore comprises an intermediate connection link extending through a leaktight and electrically insulated conduit crossing the valve body to an end connected to the annular disk.

8. The fuel injector as claimed in claim 1, wherein the electrical circuit furthermore comprises an electrical connection extending from the metal spring to an end external to the fuel injector, so that an electrical measurement can be carried out between electrical ground and the end external to the fuel injector.

* * * * *